US006523285B1

(12) United States Patent
Gilson et al.

(10) Patent No.: US 6,523,285 B1
(45) Date of Patent: Feb. 25, 2003

(54) ANIMATED MUSIC BOX CARD

(75) Inventors: Richard A. Gilson, Lenexa, KS (US); Robert B. Baker, Prairie Village, KS (US)

(73) Assignee: Hallmark Cards Incorporated, Kansas City, MO (US)

( * ) Notice: Subject to any disclaimer, the term of this patent is extended or adjusted under 35 U.S.C. 154(b) by 245 days.

(21) Appl. No.: 09/655,194

(22) Filed: Sep. 5, 2000

(51) Int. Cl.[7] ..... B09F 27/00
(52) U.S. Cl. ..... 40/124.03; 40/421; 40/456
(58) Field of Search ..... 40/124.03, 421, 40/437, 455–457, 717; 446/309, 308, 317; 84/94.1–101

(56) References Cited

U.S. PATENT DOCUMENTS 1,352,368 A * 9/1920 Horsey ..... 40/421
3,388,499 A * 6/1968 Mercorelli ..... 446/309
3,798,806 A 3/1974 Sanford ..... 40/28.1
4,102,067 A 7/1978 Tarrant ..... 40/455
4,299,041 A 11/1981 Wilson ..... 40/124.1
4,607,747 A * 8/1986 Steiner ..... 206/232
4,703,573 A 11/1987 Montgomery et al. ..... 40/455
5,139,454 A 8/1992 Earnest ..... 446/150
6,273,332 B1 * 8/2001 Thdja-Hengami ..... 229/129.1
6,298,990 B1 * 10/2001 Amrod et al. ..... 206/459.1

* cited by examiner

*Primary Examiner*—Cassandra H. Davis
(74) *Attorney, Agent, or Firm*—Pillsbury Winthrop LLP

(57) ABSTRACT

An animated music box card includes a card sheet and a box-like structure attached to the card sheet. A music box mechanism and a movable animation figure are mounted within the box-like structure. A linkage is mounted within the box-like structure to transmit rotary motion of the music box mechanism to the animation figure.

19 Claims, 3 Drawing Sheets

ANIMATED MUSIC BOX CARD

FIELD OF THE INVENTION

The present invention relates generally to the field of social expression cards, and more particularly to a social expression card that includes a music box and an animation figure.

DESCRIPTION OF THE PRIOR ART

The social expression card industry is a very large business. Consumers demand a variety of card styles, designs, art work, sentiments, and effects in order to express properly the thoughts they wish to convey to the recipient. Social expression card manufacturers constantly create new cards in order to satisfy consumer demand.

A number of cards include visual effects. Examples of such cards include pop-up cards that include a mechanic that is animated by the opening and closing of the card. Other visual effects are created by mechanics that are animated by manipulation of wheels, tabs, and sliders.

In some cards, visual effects are created automatically. For example, in Earnest, U.S. Pat. No. 5,139,454, there is disclosed a battery operated greeting card that includes a display portion that is animated when the card is opened. The card of the Earnest patent includes an animation mechanism that is actuated by a nickel-titanium alloy wire. The nickel-titanium alloy wire has the property that it contracts when an electric current is passed therethrough. Circuitry is included for providing a pulsed electric current to the wire, thereby causing the wire to contract and expand and provide motion to the animation mechanism.

Another type of social expression card provides auditory effects. For example, in Sanford, U.S. Pat. No. 3,798,806, and Tarrant, U.S. Pat. No. 4,102,067 there are disclosed greeting cards that include mechanical music boxes. In Wilson, U.S. Pat. No. 4,299,041, there is disclosed an animated device, which may be included in a greeting card, that provides both visual and auditory effects though electronic circuitry.

SUMMARY OF THE INVENTION

The present invention provides an animated music box card. The animated music box card of the present invention includes a card sheet and a box-like structure attached to the card sheet. A music box mechanism and a movable animation figure are mounted within the box-like structure. A linkage is mounted within the box-like structure to transmit rotary motion of the music box mechanism to the animation figure.

The music box mechanism includes a transversely mounted rotating shaft. The linkage includes a transmission for transmitting rotation of the shaft to a wheel rotatably mounted in the box-like structure on an axis perpendicular to the shaft. A first link has a first end movably connected to the wheel. A second link has a first end movably connected to the second end of the first link and a second end operably connected to the animation figure.

The music box mechanism and animation figure are preferably mounted to a music box and animation structure housed in the box-like structure. The music box and animation structure includes first and second structural sheet members. Each of the structural sheet members has respective inner and outer surfaces, and each of the structural sheet members has an interior cutout portion. A first mounting sheet is sandwiched between the inner surfaces of the structural sheet members. The first mounting sheet has a slot formed therein. The animation figure is pivotally mounted to the first mounting sheet on an axis perpendicular to the first mounting sheet. A second mounting sheet is affixed to the outer surface of the first structural sheet member. The second mounting sheet has a window and a keyhole formed therein. The music box mechanism is mounted to the second mounting sheet within the interior cutout The box-like structure and card sheet are preferably formed from a single sheet of paper card stock. The sheet of card stock includes three rectangular panels. A rectangular first side panel is connected along a fold line to a first panel. A second panel is connected along a fold line to the first side panel. A rectangular second side panel is connected along fold lines between the second panel and third panel. The side panels each include a pair of end tabs. A first closure flap is connected along a fold line to one end of one of the first, second, and third panels. A second closure flap is connected along a fold line to the other end of one of said first, second, and third panels. A connection flap is connected along a fold line to one of the first and third panels. The panels are folded with the connection flap being affixed to one of the side panels to form the box-like structure and the card sheet.

DESCRIPTION OF THE PREFERRED EMBODIMENTS

Figure 1:
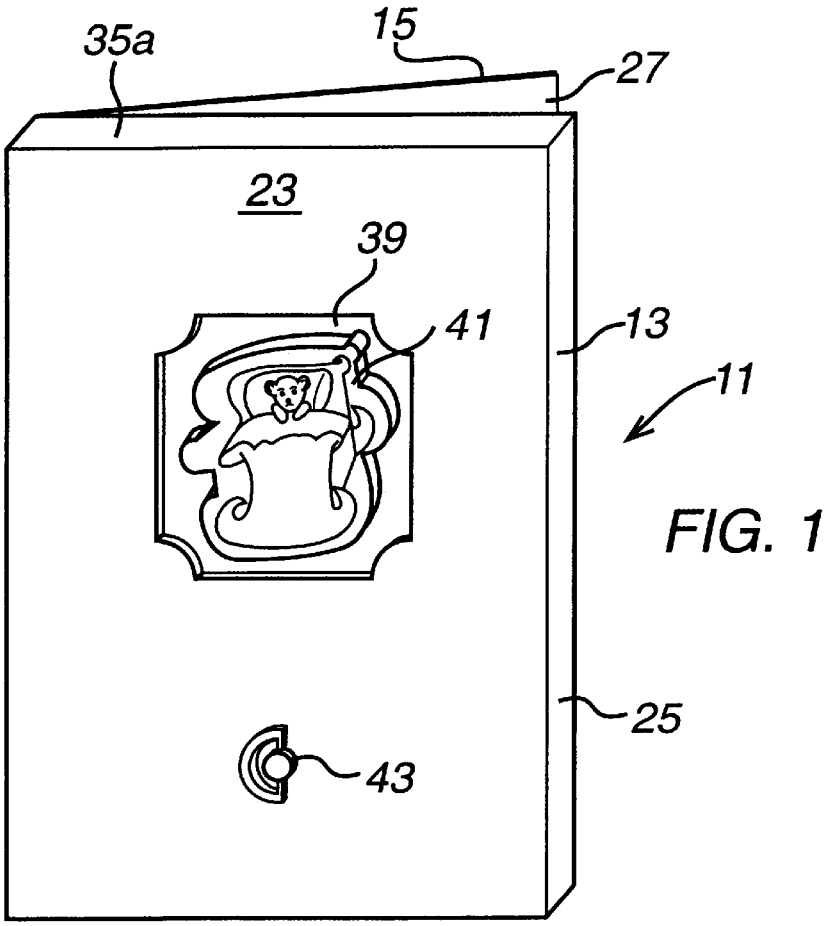
FIG. 1 is a front perspective view of an animated music box card according to the present invention.
Figure 2:
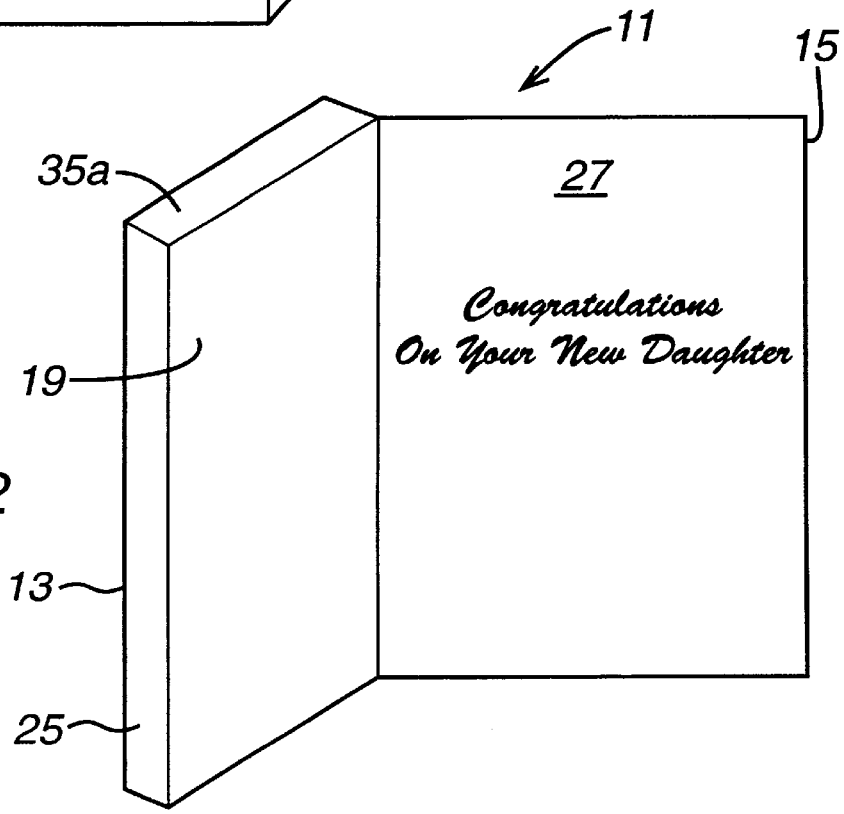
FIG. 2 is an inside perspective view of the animated music box card of FIG. 1.

Referring now to the drawings, and first to FIGS. 1 and 2, an animated music box card according to the present invention is designated generally by the numeral 11. Card 11 includes a box-like structure 13 and a card sheet 15 connected to box-like structure 13.

Figure 6:
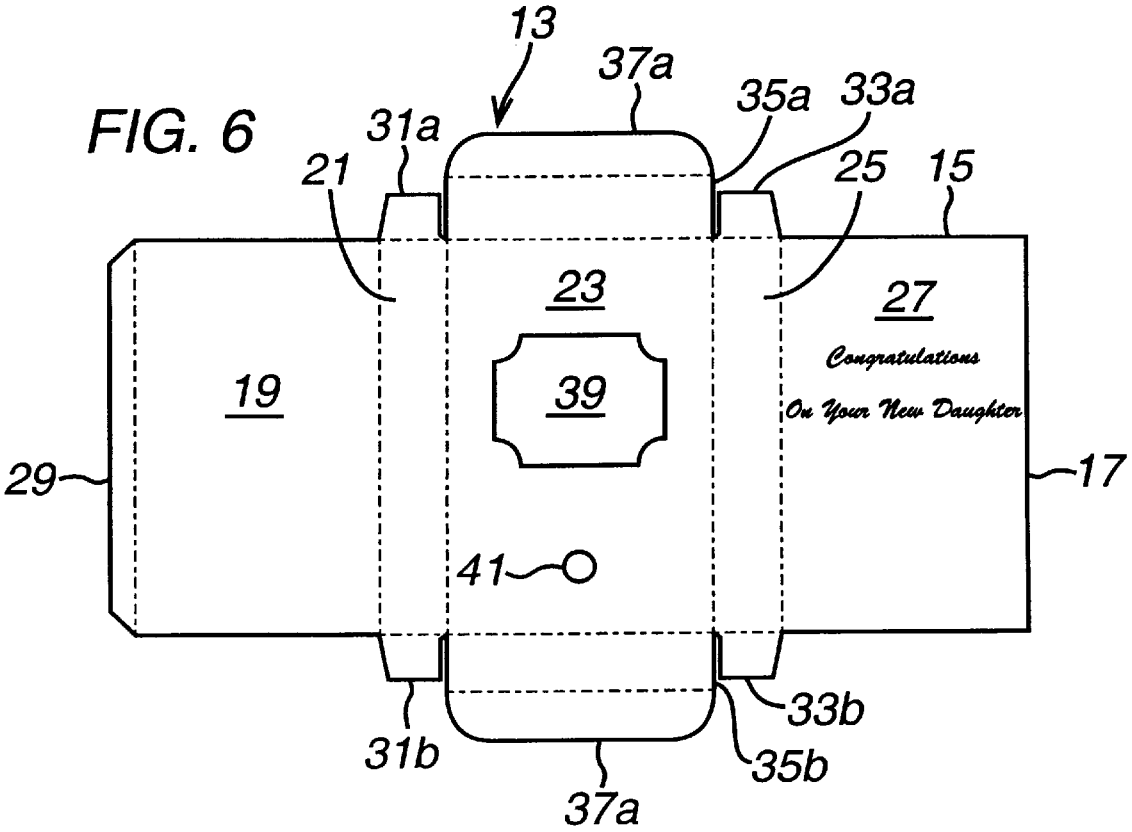
FIG. 6 is plan view of an unfolded card sheet and box-like structure according to the present invention.

Referring to FIG. 6, box-like structure 13 and card sheet 15 are preferably formed from a single sheet 17 of paper or cardstock. Sheet 17 includes a rectangular first panel 19. First rectangular panel 19 is connected by a fold line to a rectangular side panel 21. Side panel 21 is connected along a fold line to a rectangular second panel 23, which in turn is connected to a rectangular side panel 25. Side panel 25 is connected along a fold line to a rectangular third panel 27. Panels 19, 23, and 27 each have substantially identical dimensions. Side panels 21 and 25 have substantially the same dimensions as each other. First panel 19 is connected along a fold line to a connection flap 29.

Side panels 21 and 25 each have connected. thereto, along fold lines, end tabs 31 and 33, respectively. Second panel 23 has connected thereto, along fold lines, a pair of closure flaps 35. Each closure flap 35 has. connected thereto, along a fold line, a closure tab 37. Second panel 23 has formed therein a window 39 and a keyhole 41.

Panels 19 and 23 and side panels 21 and 25 are foldable into box-like structure 13. Connection flap 29 is affixed to side panel 25 along the fold line between side panel 25 and panel 27 by a suitable adhesive. Box-like structure 13 is adapted to house a music box and animation structure, which will be described in detail hereinafter. End tabs 31 and 33 and closure flaps 35 are folded over to complete box-like structure 13.

Referring to FIG. 1, an animation FIG. 41 is movably mounted within box-like structure 31. Animation FIG. 41 is formed from a cut out sheet of cardstock and it has appropriate graphics printed thereon. In the embodiment illustrated, animation FIG. 41 has the appearance of a teddy bear in a cradle. The animation mechanism of the present invention is adapted to rock animation FIG. 41 back and forth within window 39. A key 43 extends outwardly from a panel 23 of box-like 13 so that a music box mechanism may be wound.

Figure 3:
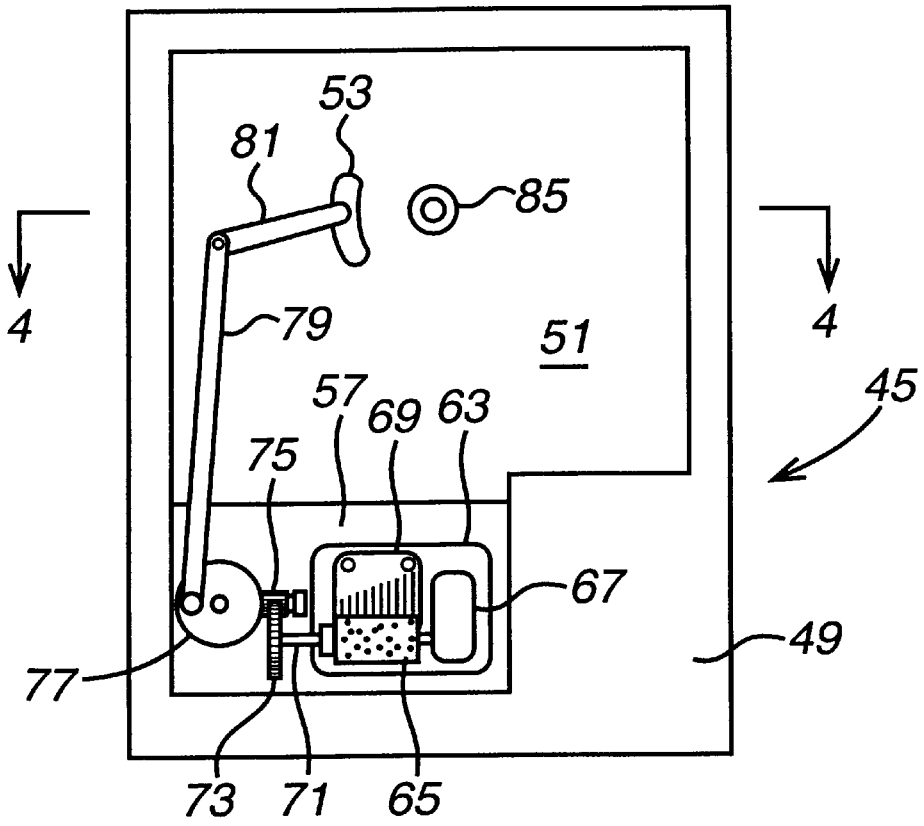
FIG. 3 is a back view of an animation and music box structure according to the present invention.
Figure 4:
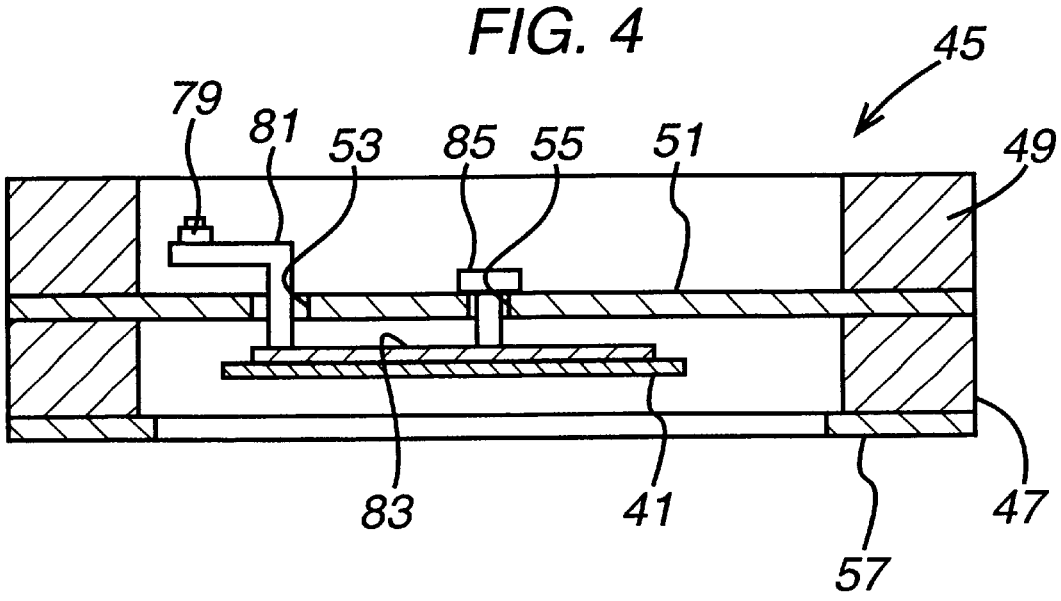
FIG. 4 is a section view taken along line 4—4 of FIG. 3.
Figure 5:
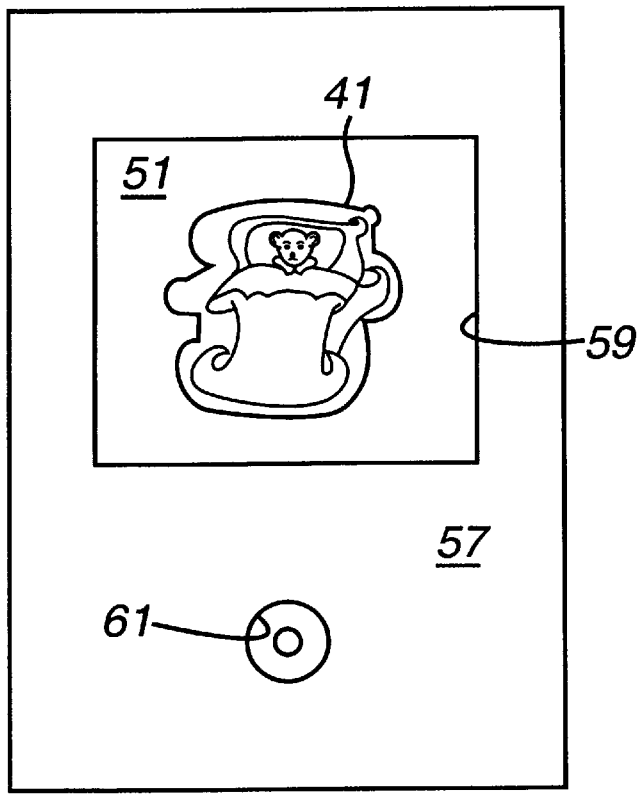
FIG. 5 is a front view of an animation and music box structure according to the present invention.

Referring now to FIGS. 3–5, there is illustrated the music box and animation structure of the present invention which is designated generally by the numeral 45. Music box and animation structure 45 includes a pair of structural sheet members 47 and 49. Structural sheet members 47 and 49 are formed from a rigid, lightweight, plastic foam material. Structural sheet members 47 and 49 are rectangular in shape and dimensioned to fit snugly within box-like structure 13. Structural sheet members 47 and 49 each have interior cut-out portions to accommodate the mechanisms of the present invention.

A first mounting sheet 51 is sandwiched between structural sheet members 47 and 49. First mounting sheet 51 is rectangular or square in shape and it is formed from cardstock. First mounting sheet 51 has a slot 53 and a pivot hole 55 formed therein.

The surface of structural sheet member 47 opposite first mounting sheet 51 has affixed thereto a second mounting sheet 57. As shown in FIG. 5, second mounting sheet 57 is rectangular and it includes a window 59 and a keyhole 61. Window 59 and keyhole 61 are positioned to be in alignment with window 39 and keyhole 41 of box-like structure 13.

A conventional music box mechanism 63 is suitably mounted to second mounting sheet 57. Music box mechanisms are generally well known in the art and they include a rotating drum 65 that is driven by a drive mechanism 67 to drive elements of a sound producing plate 69. Drum 65 is mounted on a shaft 71 that is mounted parallel to the plane of mounting sheets 51 and 57.

A first gear wheel 73 is mounted to the end of shaft 71. Gear wheel 73 engages a second gear wheel 75 that is mounted on an axis that is parallel to shaft 71. Second gear wheel 75 engages a third gear wheel 77 that is mounted on an axis perpendicular to the planes of mounting sheets 51 and 57. Third gear wheel 77 is driven by first gear wheel 73 through second gear wheel 75 to rotate in a plane parallel to mounting sheets 51 and 57.

A first link 79 is rotatably connected at one of its ends to third gear wheel 77. The other end of first link 79 is rotatably attached to a second link 81. As best shown in FIG. 4, second link 81 is generally L-shaped and it extends through slot 53 into fixed engagement with a connecting member 83 which is affixed to animation FIG. 41. Connection member 83 is rotatably mounted to first mounting sheet 51 on a pivot member 85 that extends though hole 55.

In operation, when music box mechanism 63 is wound up, rotation of drum 65 on shaft 71 produces music in the conventional way. The rotation of shaft 71 is transmitted through gear wheels 77 and 75 to gear wheel 77. The rotation of gear wheel 77 is translated through link 79 to up and down rocking motion of link 81. The up and down rocking motion of link 81 is transmitted to animation FIG. 41, thereby causing animation FIG. 41 to rock within window 39.

From the foregoing, it may be seen that the present invention provides a card with both motion and sound effects. Those skilled in the art will recognize alternative embodiments, given the benefit of this disclosure. Accordingly, the foregoing disclosure is intended for purposes of illustration rather than limitation.

What is claimed is:

1. An animated music box card, which comprises:

a card sheet;

a box structure attached to said card sheet, said box-like structure including a window;

a music box mechanism mounted within said box-like structure;

an animation figure movably mounted in said box-like structure within said window; and, a linkage mounted with said box structure connecting said music box mechanism and said animation figure.

2. The animated music box card as claimed in claim 1, wherein said music box mechanism produces rotary motion and said linkage is arranged to convert said rotary motion produced by said music box mechanism to pivotal motion of said animation figure.

3. The animated music box card as claimed in claim 1, wherein said music box mechanism includes a transversely mounted rotating shaft and said linkage includes:

a transmission for transmitting rotation of said shaft to a wheel rotatably mounted in said box structure on an axis perpendicular to said shaft;

a first link having a first and second end, said first end movably connected to said wheel;

a second link having a first end movably connected to the second end of said first link and a second end pivotally mounted within said box structure.

4. The animated music box card as claimed in claim 3, wherein said animation figure is affixed to said second link.

5. The animated music box card as claimed in claim 1, including a winding key connected to said music box mechanism and extending outwardly of said box structure.

6. The animated music box card as claimed in claim 1, wherein said box structure includes an outward facing front surface and an oppositely facing back surface and said window is formed in said front surface.

7. The animated music box card as claimed in claim 6, wherein said card sheet is connected to said box structure along an edge of said back surface.

8. The animated music box card as claimed in claim 6, including a winding key connected to said music box mechanism and extending outwardly of said box structure through said front surface.

9. The animated music box card as claimed in claim 1, wherein:

said box structure defines a plane;

said music box mechanism includes a rotating shaft mounted parallel to said plane; and, said animation figure is mounted on an axis perpendicular to said plane.

10. The animated music box card as claimed in claim 9, wherein said linkage includes:

a transmission for transmitting rotation of said shaft to a wheel mounted for rotation in said box structure on an axis perpendicular to said plane;

a first link having a first end movably connected to said wheel;

a second link having a first end movably connected to the second end of said first link and a second end operably connected to said animation figure.

11. An animated music box card, which comprises:

a card sheet;

a box structure attached to said card sheet, said box structure including a window and a keyhole; and, a music box and animation structure housed in said box structure, said music box and animation structure comprising:

a first structural sheet member;

a second structural sheet member, each of said structural sheet members having respective inner and outer surfaces, and each of said structural sheet members having an interior cutout portion;

a first mounting sheet sandwiched between the inner surfaces of said first and second structural sheet members, said first mounting sheet having a slot formed therein;

an animation figure pivotally mounted to said first mounting sheet on an axis perpendicular to said first mounting sheet;

a second mounting sheet affixed to the outer surface of said first structural sheet member, said second mounting sheet having a window and a keyhole formed therein;

a music box mechanism mounted to said second mounting sheet within said interior cutout portions of said structural sheet members, said music box mechanism including a rotating shaft; and, means for transmitting rotation of said rotating shaft to said animation figure.

12. The animated music box card as claimed in claim 11, wherein said transmitting means includes:

a linkage operably connected between said rotating shaft and said animation figure.

13. The animated music box card as claimed in claim 11, wherein said rotating shaft extends parallel to said second mounting sheet, and said transmitting means includes:

a first gear wheel mounted for rotation with said rotating shaft;

a second gear wheel mounted to said second mounting sheet on an axis parallel to said rotating shaft and engaged with said first gear;

a third gear wheel mounted to said second mounting sheet on an axis perpendicular to said rotating shaft and engaged with said second gear wheel;

a first link having a first end rotatably mounted adjacent an edge of said third gear wheel;

an L-shaped second link having a first end rotatably connected to a second end of said first link, said second link extending through said slot in said first mounting sheet into operable connection with said animation figure.

14. An animated music box card, which comprises:

a sheet including:

a rectangular first panel;

a rectangular first side panel connected along a fold line to said first panel, said first side panel including a pair of end tabs;

a rectangular second panel connected along a fold line to said first side panel;

a rectangular second side panel connected along a fold line to said second panel, said second side panel including a pair of end tabs;

a rectangular third panel connected along a fold line to said second side panel, one of said first, second, and third panels including a window and a keyhole;

a first closure flap connected along a folds line to one end of said first, second, and third panels;

a second closure flap connected along a fold line to the other end of one of said first, second, and third panels; and, a connection flap connected along a fold line to one of said first and third panels, and said panels being folded with said connection flap being affixed one of said side panels to form a box structure; and, a music box and animation structure mounted within said box structure.

15. The animated music box card as claimed in claim 14, wherein said music box and animation structure housed in said box structure comprises:

a first structural sheet member;

a second structural sheet member, each of said structural sheet members having respective inner and outer surfaces, and each of said structural sheet members having an interior cutout portion;

a first mounting sheet sandwiched between the inner surfaces of said first and second structural sheet members, said first mounting sheet having a slot formed therein;

an animation figure pivotally mounted to said first mounting sheet on an axis perpendicular to said first mounting sheet and visible through said window;

a second mounting sheet affixed to the outer surface of said first structural sheet member, said second mounting sheet having a window and a keyhole formed therein;

a music box mechanism mounted to said second mounting sheet within said interior cutout portions of said structural sheet members, said music box mechanism including a rotating shaft; and, means for transmitting rotation of said rotating shaft to said animation figure.

16. The animated music box card as claimed in claim 15, wherein said transmitting means includes:

a linkage operably connected between said rotating shaft and said animation figure.

17. The animated music box card as claimed in claim 15, wherein said rotating shaft extends parallel to said second mounting sheet, and said transmitting means includes:

a first gear wheel mounted for rotation with said rotating shaft;

a second gear wheel mounted to said second mounting sheet on an axis parallel to said rotating shaft and engaged with said first gear;

a third gear wheel mounted to said second mounting sheet on an axis perpendicular to said rotating shaft and engaged with said second gear wheel;

a first link having a first end rotatably mounted adjacent an edge of said third gear wheel;

an L-shaped second link having a first end rotatably connected to a second end of said first link, said second link extending through said slot in said first mounting sheet into operable connection with said animation figure.

18. The animated music box card as claimed in claim 14, wherein:

said connection flap is connected to said first panel; and, said third panel defines a card sheet.

19. The animated music box card as claimed in claim 18, wherein:

said first and second closure flaps are connected to said second panel; and, said window and keyhole are formed in said second panel.

* * * * *